US010811178B2

(12) United States Patent
Bange et al.

(10) Patent No.: US 10,811,178 B2
(45) Date of Patent: Oct. 20, 2020

(54) CURRENT MONITORING IN A LOAD

(71) Applicant: ZF Friedrichshafen AG, Friedrichshafen (DE)

(72) Inventors: Paul Bange, Regenstauf (DE); Thomas Maier, Neunburg v. Wald (DE); Gerald Kolar, Vienna (AT); Mohammad Kabany, Regensberg (DE); Andreas Hof, Bad Abbach (DE)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 299 days.

(21) Appl. No.: 15/776,739

(22) PCT Filed: Nov. 10, 2016

(86) PCT No.: PCT/EP2016/077308
§ 371 (c)(1),
(2) Date: May 16, 2018

(87) PCT Pub. No.: WO2017/084964
PCT Pub. Date: May 26, 2017

(65) Prior Publication Data

US 2018/0350497 A1 Dec. 6, 2018

(30) Foreign Application Priority Data

Nov. 20, 2015 (DE) ..... 10 2015 222 991

(51) Int. Cl.
*H01F 7/18* (2006.01)
*H01F 7/06* (2006.01)

(52) U.S. Cl.
CPC ..... *H01F 7/1844* (2013.01); *H01F 7/064* (2013.01); *H01F 2007/1855* (2013.01); *H01F 2007/1866* (2013.01)

(58) Field of Classification Search
CPC ..... H01F 7/1844; H01F 7/064; H01F 2007/1855; H01F 2007/1866
See application file for complete search history.

(56) References Cited

FOREIGN PATENT DOCUMENTS

| | | |
|---|---|---|
| EP | 0 929 020 A2 | 7/1999 |
| JP | 2009230463 A | 10/2009 |

OTHER PUBLICATIONS

International Search Report from corresponding application No. PCT/EP2016/077308, 13pgs., dated Mar. 9, 2017.
International Search Report on Patentability from corresponding application No. PCT/EP2016/077308, 10pgs., dated Feb. 14, 2018.
Written Opinion from corresponding application No. PCT/EP2016/077308, 7pgs.,dated Nov. 16, 2017.

*Primary Examiner* — Kyle J Moody
(74) *Attorney, Agent, or Firm* — Brinks Gilson & Lione

(57) ABSTRACT

A method for determining a current that flows through a load, wherein the current comprises a DC component and a dithering component, and the dithering component is modified in predetermined time intervals, comprises steps for recording a momentary current; determining a dithering parameter; and determining the current based on the momentary current and the dithering parameter.

7 Claims, 3 Drawing Sheets

CURRENT MONITORING IN A LOAD

CROSS-REFERENCE TO RELATED APPLICATIONS

This application is a filing under 35 U.S.C. § 371 of International Patent Application PCT/EP2016/077308, filed Nov. 10, 2016, and claims the priority of German Patent Application DE 10 2015 222 991.2, filed Nov. 20, 2015, both of which are incorporated by reference herein in their entirety.

FIELD

The invention relates to the determination of a current through a load. In particular, the invention relates to the determination of a current through a load activated by means of dithering.

BACKGROUND

Current-regulated valves are often used in hydraulic applications. In particular on a continuous valve, the electrical current flowing through the valve can be directly proportional to a hydraulic pressure. The pressure is controlled by a hydraulic control piston, which can be adjusted by means of a solenoid armature, which is under the magnetic influence of a coil. In order to circumvent a breakaway friction of the solenoid armature, or the control piston, an electrical current flowing through the coil of the valve can be composed of a direct current component and a dithering component by means of dithering. The dithering component is modified in predetermined time intervals, and is also known as ripple current, wherein a dithering period is normally selected such that the dithering frequency lies in the range of ca. 70 to 400 Hz. As a result, the solenoid armature and the control piston begin oscillating slightly, such that they can be more readily controlled by means of the DC current. An hysteresis between the electrical activation and the hydraulic effect can thus be reduced.

An activation device is normally provided for controlling the current flowing through the valve of the solenoid valve, which is connected to a control component by means of a control line, such that the dithering and the provision of the current are carried out by the activation device, while the control device mainly conveys the DC component, or an equivalent value, to the activation device.

The current actually flowing through the coil can also be determined by the activation device, and read back to the processor. The dithering has an effect on the determination of the current, however, such that an average or effective value is determined over an entire dithering period. Depending on the length of the dithering period, the associated delay may be unacceptable for control or monitoring purposes. Alternatively, the average electrical current flowing through the coil can also be continuously determined, and sent to the processor on demand. The determined current value may however already be outdated at the point in time at which it is provided.

SUMMARY

The fundamental object of the invention is to provide a better technique with which an electrical current flowing through an electrical load that is activated by dithering can be better determined. The invention solves this problem by means of the subject matter of the independent claims. The dependent claims describe preferred embodiments.

A first method for determining an average value of a current that flows through a load, wherein the current comprises a DC component and a dithering component, and the dithering component is periodically modified in a predetermined curve shape in predetermined time intervals, comprises steps for recording a momentary current, determining dithering parameters of a period length, an amplitude, and a curve shape of the dithering component, and determining the average value of the current over a period based on the momentary current and the dithering parameter.

A second method for determining an effective value of a current that flows through a load, wherein the current comprises a DC component and a dithering component, and the dithering component is periodically modified in a predetermined curve shape in predetermined time intervals, comprises steps for recording a momentary current; the determination of dithering parameters of a period length, an amplitude, and a curve shape of the dithering component; and the determination of the effective value of the current over a period based on the momentary current and the dithering parameter.

A third method for determining a DC component of a current that flows through a load, wherein the current comprises the DC component and a dithering component, and the dithering component is modified in predetermined time intervals, comprises steps for recording a momentary current; the determination of the value of the dithering component; and the determination of the current based on the momentary current and the value of the dithering component.

The determination of the current based on the momentary current can take place very quickly. A latency between a demand for determining the current and the determined current can be very short, such that the method may also be suitable for control processes that are critical for safety or are highly dynamic. Depending on the type of dithering, the dithering parameter can be a simple value that can be easily used for determining the current flowing through the load. The determination of the current can be carried out quickly and with less processing expenditure as a result. Furthermore, the current control and the dithering of the load can be better separated from one another. The dithering, in particular, can be carried out in a fully transparent manner, such that a first component for current control of the load, or a second component for determining the current, do not need to be processed in the dithering.

The dithering parameter preferably comprises an indication of the value of the dithering component. If the dithering component is known, it can be subtracted from the momentary current to obtain the current. In one embodiment, the dithering parameter is in a linear relation to the value of the dithering component.

The dithering component can be periodically modified in a predefined curve shape, wherein the dithering parameter comprises an indication of the shape of the curve. Exemplary curves comprise rectangular, triangular, or sawtooth shapes. If the curve shape and, e.g., a phase angle of the curve shape are known, the dithering component can be easily determined. The phase angle can be defined in different ways, e.g. directly as a counter reading of time intervals, wherein a predefined number of time intervals per period is provided.

In another embodiment, the dithering parameter comprises an indication of the length of the periods in the dithering.

The current can be determined such that it corresponds to an average value over a dithering period. This determination does not require that the current be monitored over the course of a dithering period, but rather, can preferably be determined mathematically, based on the momentary current and one or more dithering parameters. The further processing of the current can be simplified as a result. In another preferred embodiment, the determined current comprises an effective value over a period. This results in increased flexibility in selecting the curve shape for the dithering. In yet another embodiment, the determined current only comprises the DC component. The dithering component is removed from the determination thereby. This approach may be advantageous, for example, when the dithering component has equal portions of negative and positive values over the course of a period. In this case, the DC component can also correspond to the average value for the current flowing through the load.

The method can be implemented in particular by means of two devices, wherein a control device controls and samples the current through the load, and the other device controls the activation device.

An activation device for activating a current through a load, wherein the current comprises a predetermined direct current and a dithering current that is periodically modified in predetermined time intervals on the basis of dithering parameters, wherein the dithering parameters comprise a period length, an amplitude, and a curve shape of the dithering component, comprises a sampling device for determining a momentary current through the load, and an interface for supplying the momentary current and the dithering parameter. The activation device can be designed, e.g., as an integrated circuit or an integrated control component. The dithering is preferably entirely controlled by the activation device. Dithering parameters such as curve shape, period length, number of time intervals per period, or an increment of the dithering current in successive time intervals may be stored permanently, or they may be entered externally. Furthermore, the DC component can preferably also be entered externally. Communication between the activation device and another control device can take place, e.g., by means of a serial interface. By way of example, the SPI bus is suitable for this, which has been tested on an industrial level and is widely distributed.

A device for determining an average value of a current through a load, which is activated by means of the activation device described above, is configured to request a momentary current determined by the activation device and the dithering parameter, and to determine the average value of the current through the load on the basis of the momentary current and the dithering parameter.

A device for determining an effective value of a current through a load, which is activated by means of the activation device described above, is configured to request a momentary current determined by means of the activation device and the dithering parameters, and to determine the effective value of the current through the load based on the momentary current and the dithering parameters.

A device for determining a DC component of a current through a load, which is activated by means of the activation device described above, is configured to request a momentary current determined by means of the activation device and a value of the dithering component, and to determine the current through the load based on the momentary current and the dithering component.

One or more additional dithering parameters can also be used by the device for determining the current, wherein the additional parameter(s) have been defined for the activation device at an earlier time, and are therefore known to the device.

In the latter embodiment, the determination of the current takes place in the device; the method described further above can however also be carried out entirely by the activation device, wherein the specific current flowing through the load can also be exported.

As a result of the exemplary determination of the momentary current together with the increment of the dithering current, it is possible to make a comparison with a target value at any time. As a result, it is not necessary to wait for a current to be determined over the course of a dithering period. By way of example, a target current determined over a dithering period combined with a dithering parameter serves as the target value. As a matter of course, another target value may also be used. As a result, it is also possible to monitor the dithering to ensure it is functioning correctly.

Using the method, the correct functioning of the load can be better and more quickly monitored than with the prior art.

BRIEF DESCRIPTION OF DRAWINGS

The invention shall now be described in greater detail with reference to the attached figures, in which.

DETAILED DESCRIPTION

Figure 1:
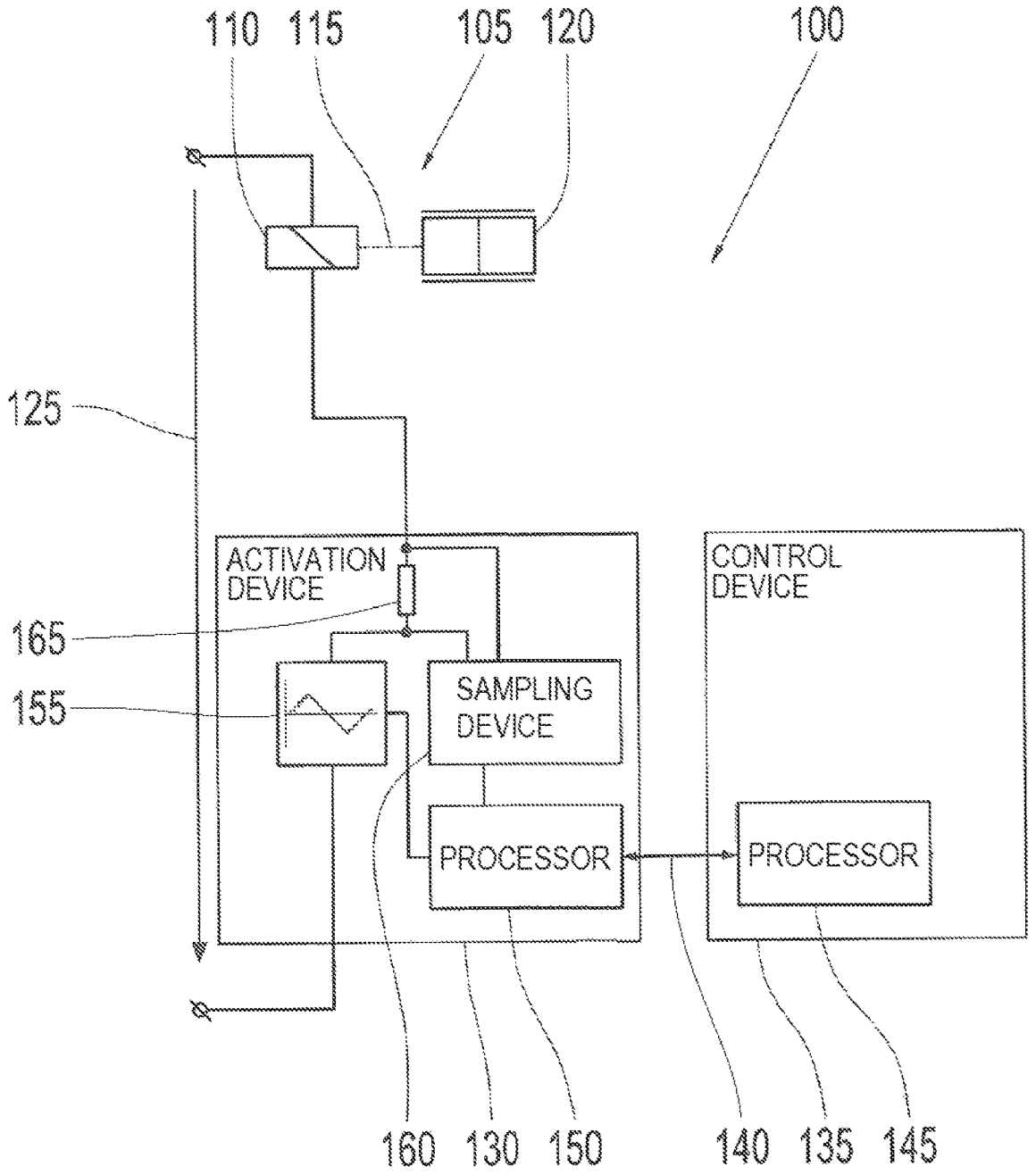
FIG. 1 shows a circuit diagram for a system for controlling a current through a load.

FIG. 1 shows a circuit diagram for a system 100 for controlling a current through a load 105. The load 105 can comprise, in particular, a continuous current-controlled hydraulic valve, in particular a continuous valve. The continuous valve allows for a continuous transition between switch positions, such that a volume flow of a hydraulic fluid can be adjusted proportionally. The continuous valve can comprise a proportional valve, a regulating valve, or a servo valve, in particular for controlling a gearing in a drive train of a motor vehicle, for example. In the depicted embodiment, the load 105 thus comprises a coil 110 with an armature 115, also referred to as a solenoid armature, that acts on a hydraulic piston 120, also referred to as a control piston. A hydraulic circuit through the hydraulic valve is not shown in FIG. 1.

A current through the load 105 is supplied by a current source 125, and controlled by means of an activation device 130. The activation device 130 can communicate with a control device 135 by means of an interface 140. The control device 135 normally comprises a processor 145, which is configured to determine a specification for the current flowing through the load 105, and to send this to the activation device 130, in order to fulfill a predetermined control task.

The activation device 130 comprises a processor 150, a current control 155 for controlling a current flowing through the load 105, and a sampling device 160 for determining a momentary value of the current flowing through the load 105. In the illustrated embodiment, a series resistor (shunt) is inserted in the current path of the load 105, wherein the sampling device 160 determines a voltage passing through the series resistor 165.

The current control 155 is configured to adjust a current through the load 105 composed of two components. A DC component can preferably be specified externally via the interface 140, and dithering component is generated by the current control 155. The dithering component shall be described in greater detail below in reference to FIG. 2. Parameters for executing the dithering can be stored permanently in the activation device 130, or can be entered externally by means of the interface 140. The dithering parameters are normally initialized only once, and then no longer modified. The DC component that is to flow through the load 105 is then entered externally via the interface 140 as needed, and implemented automatically by the activation device 130 or the current control 155. If the current actually flowing through the load 105 is to be supplied, then the momentary current can be sampled by means of the sampling device 160.

It is proposed that the sampled momentary current be calculated on the basis of a dithering parameter that applies at the time of the sampling, in order to determine the current through the load 105 as an average value, effective value, or in the form of a DC component. In a first variation, the momentary current and the dithering parameter can be processed by the activation device 130, such that the determined current can be exported by means of the interface, and in another variation, the momentary current and the dithering parameters are exported via the interface 140, and a determination of the current takes place externally, e.g. by means of the control device 135, or its processor 145.

Figure 2:
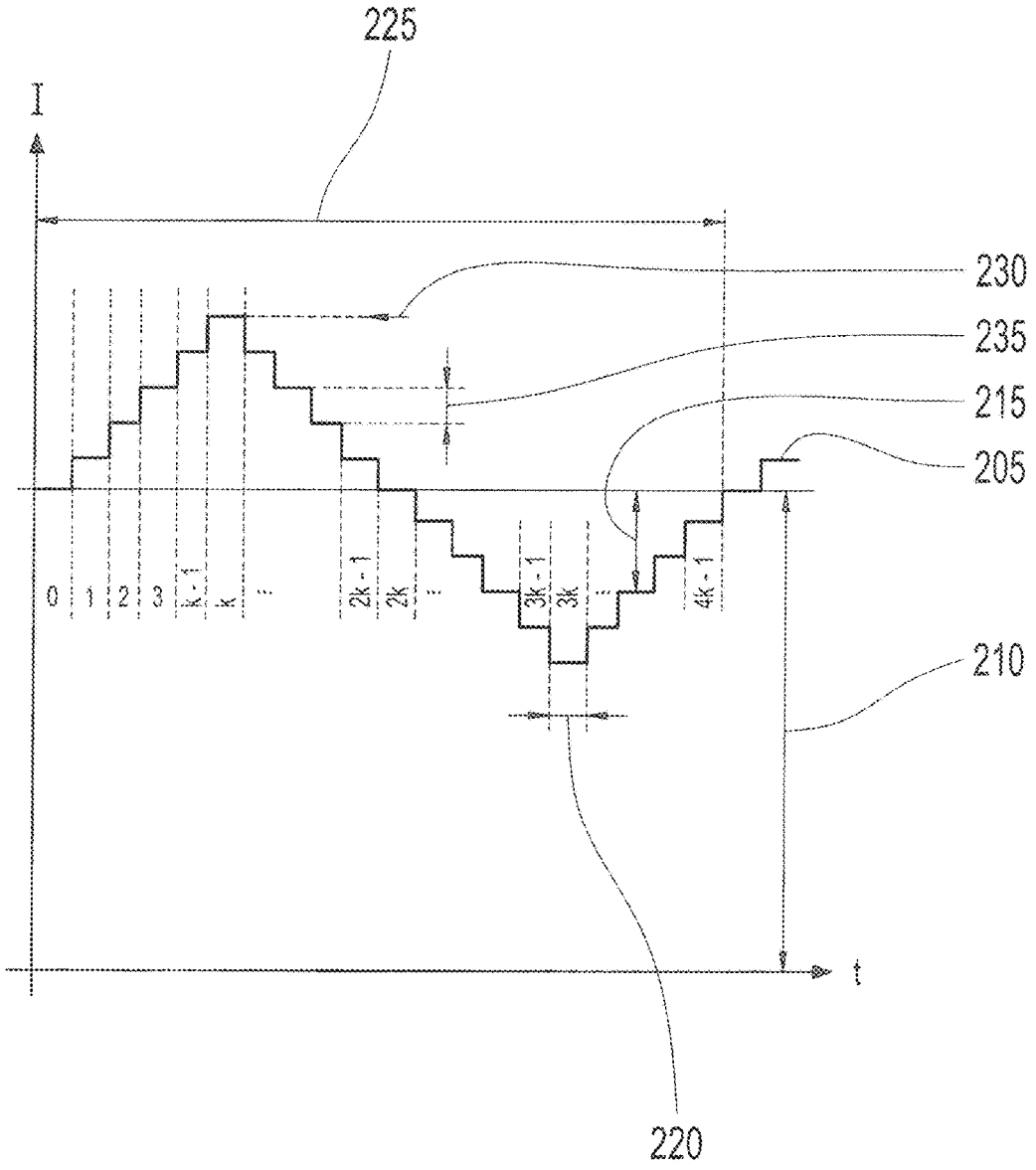
FIG. 2 shows an exemplary curve for a current through the load shown in FIG. 1.

FIG. 2 shows an exemplary curve of a current 205 through the load 105. The current 205 is composed at all times of a DC component 210 and a dithering component 215. The dithering component 215 can be only positive, only negative, or, as depicted, positive or negative at different points in time, in relation to the DC component 210. The dithering component 215 changes at predetermined time intervals 220, wherein a predetermined number of time intervals 220 results in a period length 225. Further parameters affecting the dithering can comprise an amplitude 230 or an increment 235. Furthermore, a curve shape of the dithering component 215 is decisive for the absolute value thereof at an arbitrary point in time.

A triangular dithering is shown by way of example, which is frequently used for controlling a hydraulic valve serving as the load 105. The dithering component 215 increases at constant increments 235 in the time intervals 220 0 to k to a maximum amplitude 230, is then reduced in increments until reaching a time interval 220 3k, and is then again increased in increments until reaching the time interval 220 4k−1. The decreasing and increasing take place in a linear manner over time. The variable k can be specified in order to produce a predefined relationship between the period length 225 of the dithering and the time interval 220.

The average of the dithering component 215 over a complete period 225 is 0 in the depicted triangular shape. The effective value of the dithering component 215 corresponds to $2/\sqrt{3}$ of the peak value in the selected triangular form, wherein the peak value is the difference between the maximum value and the minimum value of the dithering component 215, thus corresponding to twice the amplitude 230 in this case. Other curve shapes than the triangular shape are also possible, e.g. a sine wave, sawtooth, or rectangular curve form can be used in other embodiments.

The activation device 130 is configured to superimpose the dithering component 215 with the externally specified DC component 210. The dithering component 215 is determined entirely by the activation device 130 thereby, on the basis of the specified parameters 220 to 235, the shape of the curve, and other applicable parameters.

In order to determine the current 205 flowing through the load 105 at a specific point in time, an average value or effective value of the current 205 can be determined over a period 225 with different embodiments of the DC component 210. The determination takes place thereby on the basis of a momentary current flowing through the load 105, and one or more dithering parameters. The momentary current is a current value that flows through the load 105 within a time interval 220 at which the determination is carried out.

Figure 3:
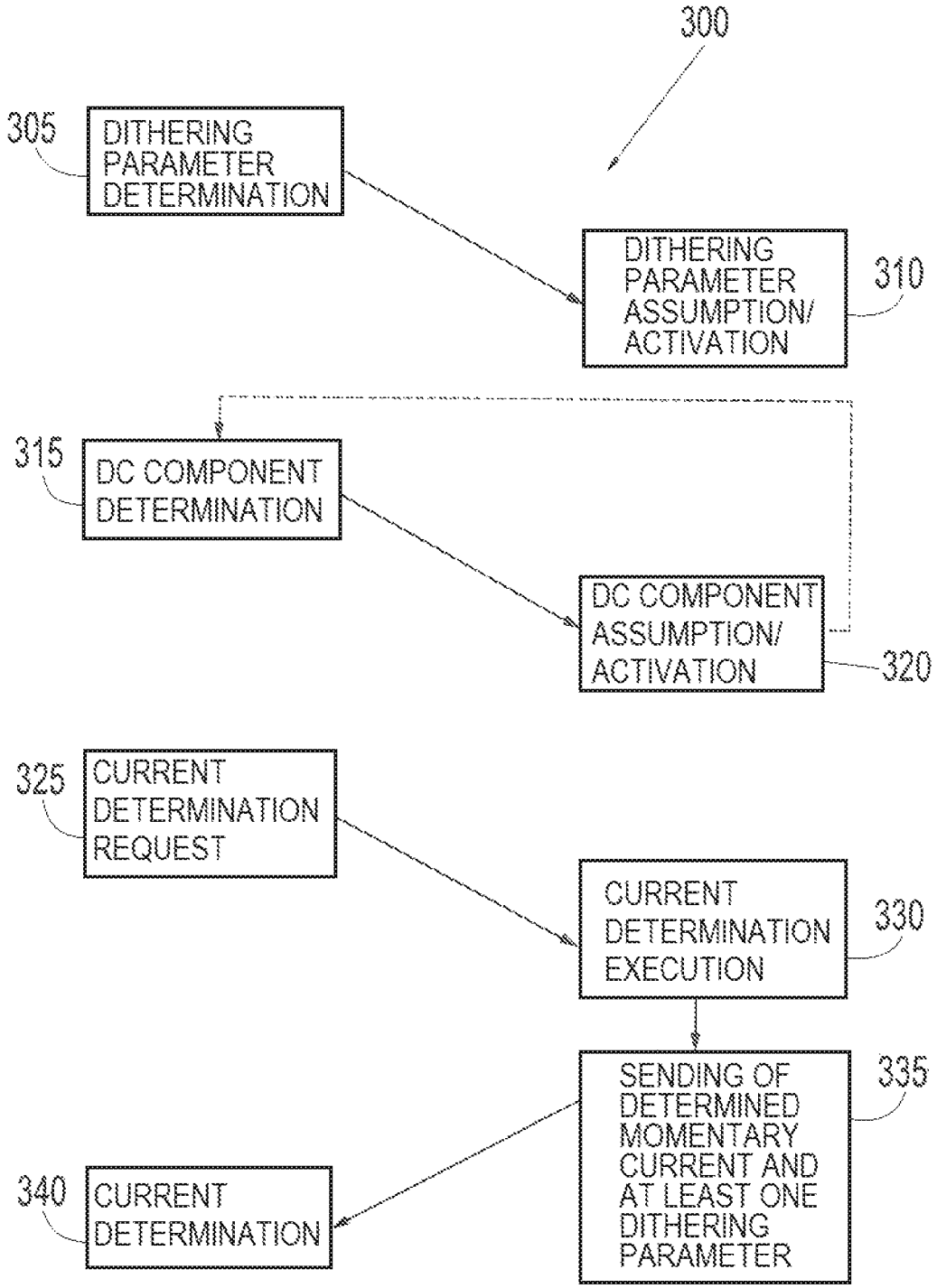
FIG. 3 shows a flow chart for a method for determining the current flowing through the load shown in FIG. 1.

FIG. 3 shows a flow chart for a method 300 for determining the current 205 flowing through the load 105 shown in FIG. 1. Steps shown in the left-hand region are preferably carried out by the control device 135, whereas steps shown in the right-hand region are preferably processed by the activation device 130.

Independently of the actual determination of the current, a dithering parameter is normally determined by the control device 135 in step 305, and assumed or activated by the activation device 130 in step 310. Depending on the configuration of the interface 140, the communication between the control device 135 and the activation device 130 can comprise an addressing and access to one or more predefined registers by one of the components 130, 135. Each dithering parameter can have its own register in the activation device 130. The control device 135 can then write appropriate values for the desired dithering parameters in the individual registers.

In a normal operation of the system 100, a desired DC component 210 is determined in step 315, sent to the activation device 130, and assumed or activated there in step 320. Steps 315 and 320 are normally executed repeatedly.

In order for the control device 135 to determine the current through the load 105, a current determination is requested in step 325, and executed by the activation device 130 in step 330. The determined momentary current and at least one dithering parameter are provided or supplied in step 335, and a determination of the actual current flowing through the load 105 by the control device 135 is established in step 340. The dithering parameter in step 335, and potentially other parameters, are used thereby, which are known, for example, by the control device 135 from one of the steps 305 or 315. The other parameters can comprise, for example, a period length for the dithering, or a dithering frequency (step 305).

The determination of the current 205 can also be carried out in another embodiment by the activation device 130. The determined current is subsequently sent or supplied to the control device 135.

In order to determine the current 205 on the basis of the momentary current, normally at least the time interval 220 in which the dithering took place when the momentary current was determined must be known. The dithering component 215 can then be computed as an absolute value, e.g. when the curve shape, and the period length 225, or the variable k in the example shown in FIG. 2 are known. The desired current 205 can then be determined based on the momentary current minus the dithering component 215.

It is preferred that only one dithering parameter, based on an individual current determination, is exported together with the momentary current by the activation device 130. In particular, the dithering parameter can also be provided as a numerical index, indicating the time interval 220 in which the momentary current is determined. The index is preferably reset to a predetermined value by the activation device 130 after each period 225, and incremented successively at each time interval 220. If the interface is an SPI bus, one or more registers can be provided for the momentary current, and one or more registers can be provided for the index.

REFERENCE SYMBOLS

100 system
105 load
110 coil
115 armature
120 piston
125 current source
130 activation device
135 control device
140 interface
145 processor
150 processor
155 current control
160 sampling device
165 series resistor
205 current
210 DC component
215 dithering component
220 time interval
225 period length
230 amplitude
235 increment
300 method
305 dithering parameter determination
310 dithering parameter assumption/activation
315 DC component determination
320 DC component assumption/activation
325 current determination request
330 current determination execution
335 sending of determined momentary current and at least one dithering parameter
340 current determination

What is claimed is:

1. A method for determining an average value of a current that flows through a load, wherein the current comprises a DC component and a dithering component, and the dithering component is periodically modified in predetermined time intervals in a predetermined curve shape, the method comprising:

recording a momentary current;

determining dithering parameters of a period length, an amplitude, and a curve shape of the dithering component; and determining the average value of the current based on the momentary current and the dithering parameters.

2. An activation device for activating a current through a load, wherein the current comprises a predetermined direct current and a dithering current periodically modified in predetermined time intervals on a basis of dithering parameters, wherein the dithering parameters comprise a period length, an amplitude, and a curve shape of the dithering component, the activation device comprising:

a sampling device for determining a momentary current through the load and an interface for supplying the momentary current and the dithering parameters.

3. A device for determining an average value of a current through a load, which is activated by means of an activation device such that the current comprises a predetermined direct current and a dithering current periodically modified in predetermined time intervals on a basis of dithering parameters, wherein the dithering parameters comprise a period length, an amplitude, and a curve shape of the dithering component, the device configured to:

request a momentary current determined by the activation device; and determine the average value of the current through the load based on the momentary current and the dithering parameters.

4. A method for determining an effective value of a current that flows through a load, wherein the current comprises a DC component and a dithering component, and the dithering component is periodically modified in predetermined time intervals in a predetermined curve shape, the method comprising:

recording a momentary current;

determining dithering parameters of a period length, an amplitude, and a curve shape of the dithering component; and determining the effective value of the current over a period, based on the momentary current and the dithering parameters.

5. A method for determining a DC component of a current that flows through a load, wherein the current comprises a DC component and a dithering component, and the dithering component is modified in predetermined time intervals, the method comprising:

recording a momentary current;

determining the value of the dithering component; and determining the current based on the momentary current and the value of the dithering component.

6. A device for determining an average value of a current through a load, which is activated by an activation device such that the current comprises a predetermined direct current and dithering current periodically modified in predetermined time intervals on the basis of dithering parameters, wherein the dithering parameters comprise a period length, an amplitude, and a curve shape of the dithering component, the device configured to:

request a momentary current determined by means of the activation device and the dithering parameters; and determine the average value of the current through the load based on the momentary current and the dithering parameters.

7. A device for determining a DC component of a current through a load, which is activated by an activation device such that the current comprises a predetermined direct current component and a dithering component modified in predetermined time intervals, the device configured to:

request a momentary current determined by the activation device and a value of the dithering component; and determine the DC component of the current through the load based on the momentary current and the dithering component.

* * * * *